US011512913B1

(12) United States Patent
Christensen

(10) Patent No.: US 11,512,913 B1
(45) Date of Patent: Nov. 29, 2022

(54) AR-TYPE RIFLE LOWER RECEIVER WITH INTEGRATED GRIP

(71) Applicant: Craig A. Christensen, Yuba City, CA (US)

(72) Inventor: Craig A. Christensen, Yuba City, CA (US)

( * ) Notice: Subject to any disclaimer, the term of this patent is extended or adjusted under 35 U.S.C. 154(b) by 0 days.

(21) Appl. No.: 17/300,661

(22) Filed: Sep. 16, 2021

Related U.S. Application Data

(60) Provisional application No. 63/204,178, filed on Sep. 17, 2020.

(51) Int. Cl.
*F41A 23/00* (2006.01)
*F41A 3/66* (2006.01)
*F41C 23/00* (2006.01)

(52) U.S. Cl.
CPC ..... *F41A 3/66* (2013.01); *F41C 23/00* (2013.01)

(58) Field of Classification Search
CPC ..... F41A 3/66; F41C 23/00; F41C 23/10
See application file for complete search history.

(56) References Cited

U.S. PATENT DOCUMENTS

| | | | | |
|---|---|---|---|---|
| 11,306,986 | B1 * | 4/2022 | Titus | F41A 11/04 |
| 2020/0182571 | A1 * | 6/2020 | Noonan | F41A 17/36 |
| 2021/0372725 | A1 * | 12/2021 | Gibbens | F41A 3/74 |

* cited by examiner

*Primary Examiner* — J. Woodrow Eldred

(57) ABSTRACT

An AR-type rifle lower receiver comprises a lower portion having a supplemental opening or recess adjacent the rifle's trigger-guard opening for receiving the middle finger of the user's hand. In addition, a juxtaposed curved boundary surface spaced laterally and rearwardly with respect to the supplemental opening is provided to define a comfortable "grip" bearing surface for the area between the thumb and index finger of the user's hand when the user positions his/her index finger on the rifle's trigger.

6 Claims, 3 Drawing Sheets

FIG. 1
PRIOR ART
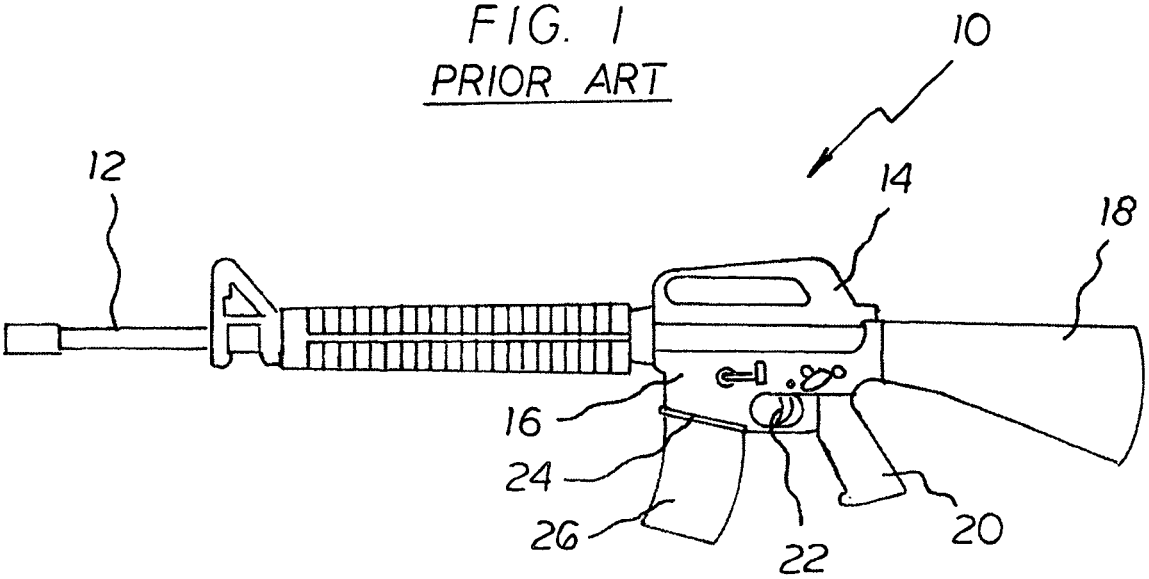
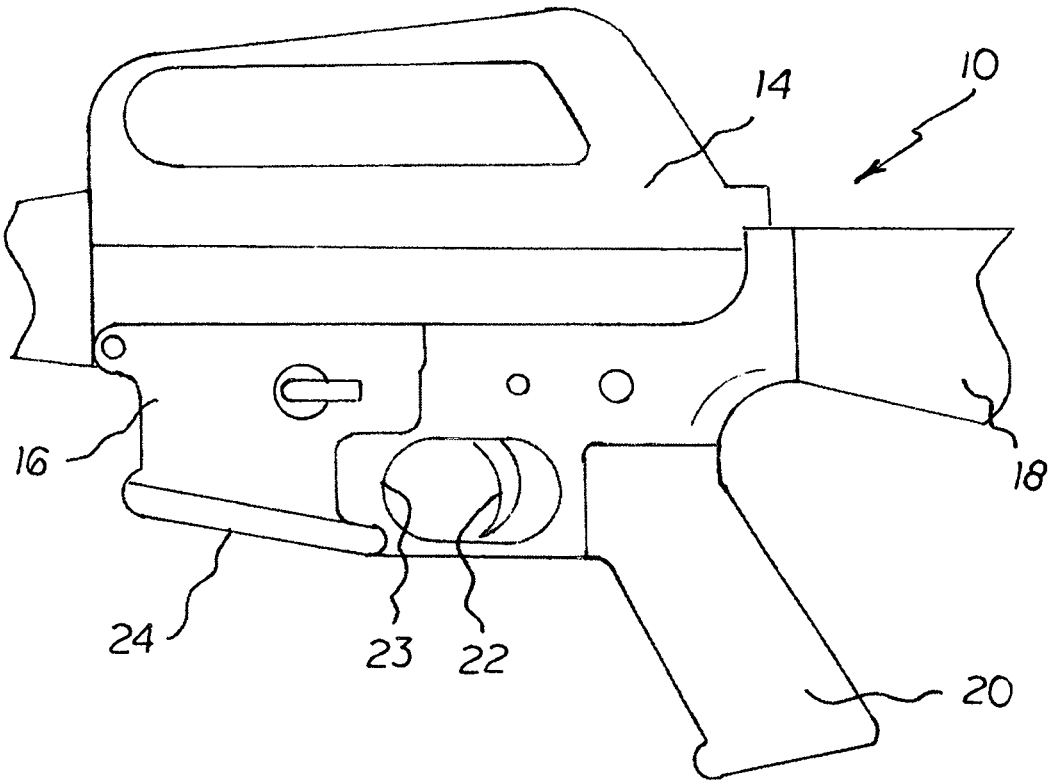
FIG. 2
PRIOR ART

FIG. 3
PRIOR ART
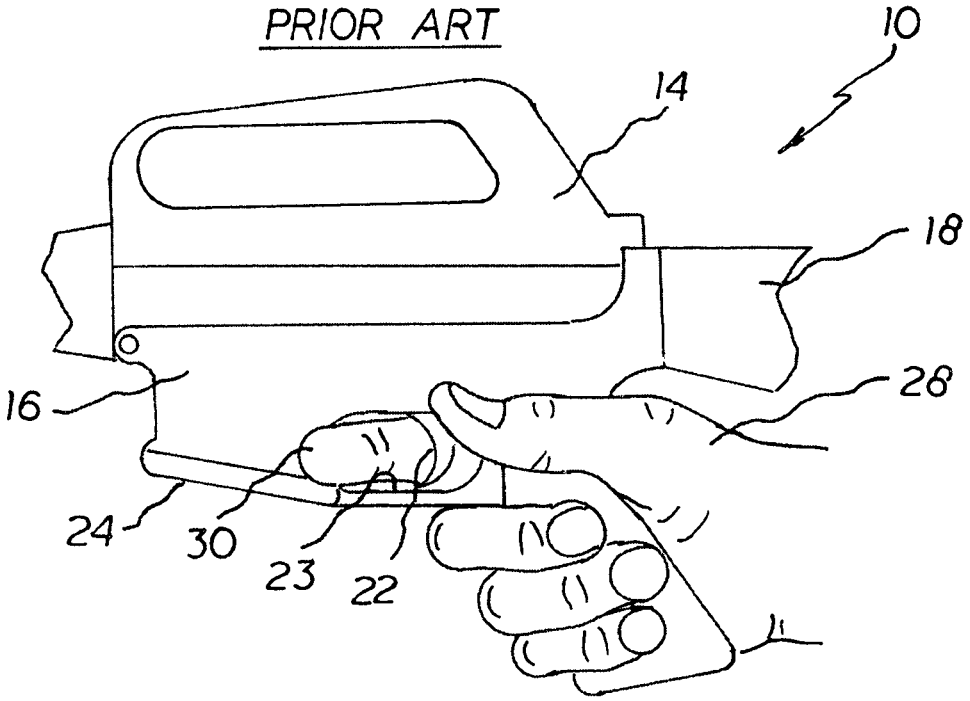
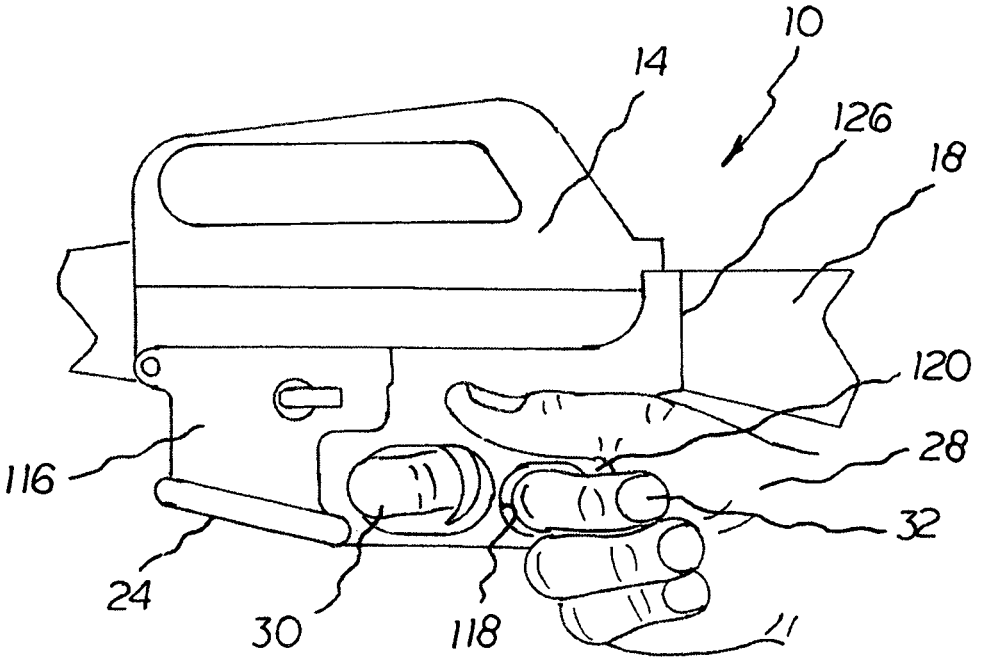
FIG. 4

FIG. 5
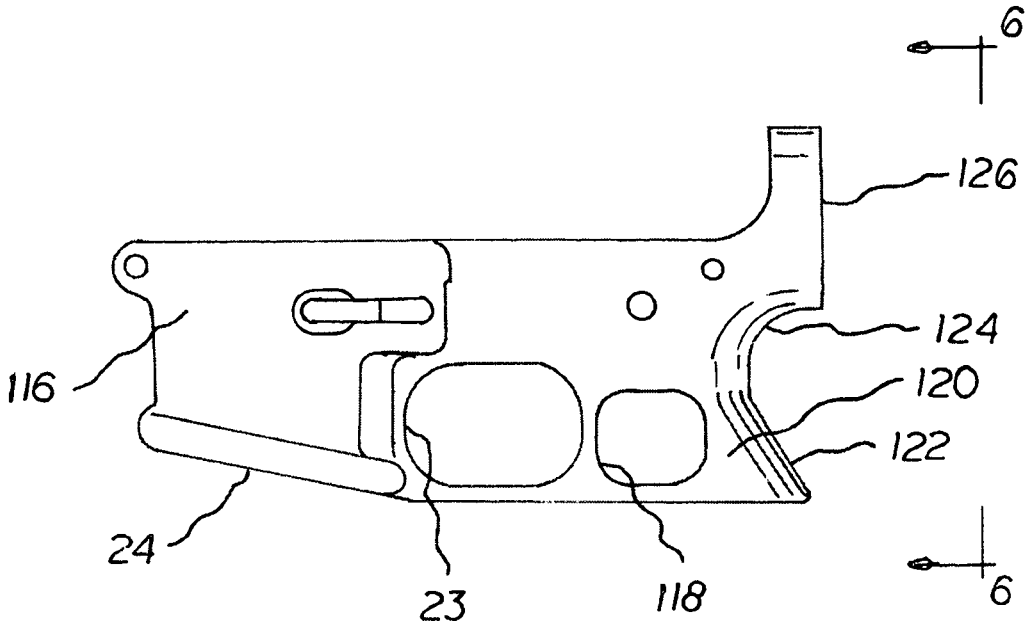
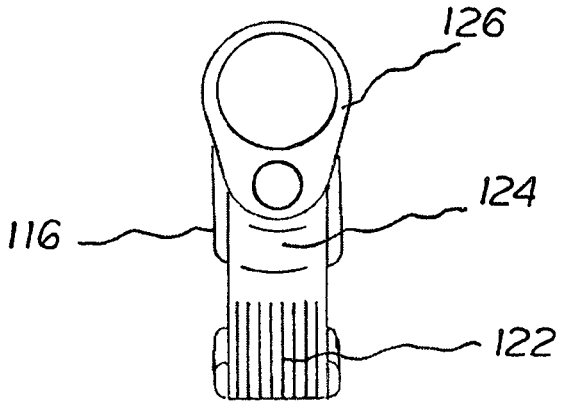
FIG. 6

AR-TYPE RIFLE LOWER RECEIVER WITH INTEGRATED GRIP

RELATED APPLICATION

This non-provisional application claims priority for all purposes on and of my prior provisional application, Ser. No. 63/204,178 filed Sep. 17, 2020, entitled: AR-Type Rifle Lower Receiver With Integrated Grip. To perfect this claim, a duly executed Application Data Sheet Under 37 CFR 1.76 is being filed concurrently with this application. The aforementioned prior provisional application, Ser. No. 63/204,178; etc. and the Application Data Sheet hereby are incorporated in and made part of this non-provisional application.

FIELD OF THE INVENTION

The present invention relates generally to AR15-type rifles, and more particularly to a lower receiver for an AR-type rifle which is constructed in such a unique way as to obviate and avoid the conventional "pistol-grip" typically employed on such weapons.

DESCRIPTION OF THE PRIOR ART

AR15-type rifles are in widespread use in the United States for hunting, target shooting, protection of persons and property, and other legitimate activities. Notwithstanding, many States have restricted the use of such popular weapons by legislating limitations on the number and type of features such weapons can include in combination. Typically, AR-type gun legislation comprises a list of banned features. If an AR-type weapon includes any two features from that list "together" on the same gun, the weapon will be prohibited for use. One extremely popular listed feature is a detachable magazine. In my prior U.S. Pat. Nos. 6,739,082 and 10,330,406, I describe and claim non-detachable magazine constructions that can be used without violating legislation listing a detachable magazine. However, many users of AR15-type rifles still want to use guns with detachable magazines.

Another extremely popular banned (listed) feature is the "pistol grip" contained on most if not all AR15-type rifles. A problem exists therefore when a gun owner wishes to use an AR15-type rifle including both a detachable magazine and a pistol grip on the same weapon, yet not be in violation of any State legislation limiting use of such popular features together or in combination on the same rifle.

In order to overcome this problem, it is the primary object of the present invention to uniquely provide an AR15-type rifle that dispenses with the conventional "pistol grip" feature found on most such weapons, yet retains the conventional detachable magazine feature.

Another aspect of complying with legislation restricting use of AR15-type rifles in most States is the requirement that removal of a listed feature may not be easily voided by simple modification, i.e. the elimination of the feature must be permanent (not capable of being added back by simple modification).

It is yet another primary object of the present invention to provide an AR-type rifle that includes a detachable magazine while permanently omitting the conventional pistol grip feature in favor of a grip integrated into the body of the weapon's lower receiver in such a manner as to avoid violating the State legislation banning such feature.

BRIEF DESCRIPTION OF THE INVENTION

Against the foregoing background, the present invention provides an improved AR-type lower receiver that advances the state of the art by combining in a unitary device several unique advantageous features unforeseen by the known prior art exemplified above. In brief, the present invention features a lower receiver with a lower portion having a supplemental opening or recess adjacent the rifle's trigger-guard opening for receiving the middle finger of the user's hand. In addition, a juxtaposed curved boundary surface spaced laterally and rearwardly with respect to the supplemental opening is provided to define a comfortable "grip" bearing surface for the area between the thumb and index finger of the user's hand when the user positions his/her index finger on the rifle's trigger.

By dispensing with the conventional "pistol grip," the AR-type rifle incorporating the present invention can legally retain the detachable cartridge magazine feature in those States which prohibit use of AR-type rifles having in combination both a pistol grip and a detachable magazine.

The above and numerous other objects of the invention will become evident from the following more detailed description of the invention, taken with reference to the annexed drawings.

BRIEF DESCRIPTION OF THE DRAWINGS

The present invention will be better understood and the above objects as well as objects other than those set forth above will become more apparent after a study of the following detailed description thereof. Such description makes reference to the annexed drawing wherein:

FIG. 1 is a side view of a complete prior art firearm of the AR-type.

FIG. 2 is an enlarged side view of the portion of the prior art firearm of FIG. 1 showing the lower receiver portion thereof and a conventional "pistol grip" attached thereto.

FIG. 3 is an enlarged sideview showing a user's hand in engagement with the pistol grip on the prior art firearm of FIGS. 1 and 2.

FIG. 4 is an enlarged side view of the lower receiver portion of the present invention showing a user's hand in engagement therewith.

FIG. 5 is an enlarged side view of the lower receiver portion of the present invention depicting the grip portion integrated therewith.

FIG. 6 is an end view taken along line 6-6 of FIG. 4.

DESCRIPTION OF THE PREFERRED EMBODIMENT

With reference to the drawings, at least one preferred embodiment of a new and improved AR-TYPE RIFLE LOWER RECIEVER WITH INTEGRATED GRIP embodying the principles and concepts of the present invention now will be described in sufficient detail to provide a complete "written description" of the invention.

Turning initially to FIGS. 1-3, there is schematically shown a firearm typically of a prior art AR-Type rifle designated by reference sign 10. Rifle 10 generally comprises a barrel 12, a frame comprising an upper receiver 14 and a lower receiver 16, a stock 18, a pistol grip 20 protruding, substantially as depicted, below the lower receiver 16, a trigger or firing mechanism 22 extending downwardly into transverse through-opening 23, and a well or receptacle 22 in the lower receiver 16 (FIG. 2) for receiving a detachable cartridge magazine, all as is notoriously well known in the art.

The extent to which the pistol grip 20 extends below and away from the lower receiver 16 adjacent the firing mechanism 22 and its transverse through-opening 23 in the prior art firearm 10 clearly is shown in FIG. 3. Substantially as depicted in FIG. 3, a user conveniently and easily can engage the pistol grip 20 with the hand 28 all of the while placing his/her index finger 30 on the firing mechanism or trigger 22 via through-opening 23. With respect to the prior art AR-Type firearm, such as that schematically depicted in FIGS. 1-3, it should be appreciated that the pistol grip 20 and the detachable magazine 26 are two of the most popular features sought by consumers when purchasing such firearms.

In accordance with a broad aspect of the present invention, I have conceived of a unique lower receiver configuration for an AR-Type firearm which dispenses with the prior art "pistol grip" and instead provides a functional and effective "grip portion" integrally forming part and parcel of the lower receiver per se. Such a novel lower receiver configuration, as fully disclosed herein, provides the user a non-restricted firearm including a detachable cartridge magazine which then legally can be used in those States prohibiting use of the prior art AR-Type firearms which include both a detachable magazine and a pistol grip protruding below the lower receiver between the trigger mechanism and the stock (FIGS. 1-3).

More specifically, turning now to FIGS. 4-6, there is depicted, in accordance with my invention, a preferred embodiment of a new and improved lower receiver construction for an AR-Type firearm 10 designated by reference number 116. Lower receiver 116 includes the usual detachable cartridge magazine well or receptacle 24 and trigger or firing mechanism transverse through-opening 23, but omits entirely the usual pistol grip 20 and pistol grip mounting lug (not shown) normally attached to the lower right corner portion of the prior art lower receiver (see FIG. 3). Improved lower receiver 116 additionally includes a supplemental transverse through-opening 118 positioned adjacent opening 23 thereby defining a lower-receiver-end-grip portion 120 forming the rearward or right-most terminal portion of the lower receiver, substantially as depicted. Through-opening 118 is sufficiently sized and configured to allow passage therethrough of the user's middle finger as will be further explained below.

As best seen in FIGS. 5 and 6, the lower-receiver-end-grip portion 120, in turn, includes a bottom rounded end-surface portion 122 and a contiguous upper rounded end-surface portion 124 to define a "grip engagement end surface" extending from the lower right-hand corner of the lower receiver 116 upward to the left, then curving to the right to intercept the stock mounting end face 126.

By the foregoing construction of lower receiver 116, in use, the user can easily grip the lower-receiver-end-grip portion 120 by inserting his/her middle finger 32 through transverse through-opening 118, while placing his/her index finger 30 on firing mechanism 22. At the same time the user's thenar webspace (i.e. the area between the thumb and the index finger) is caused to rest comfortably on and engage with suitable pressure the lower-receiver-end-grip portion 120 comprising bottom rounded end-surface portion 122 and its contiguous upper rounded end-surface portion 124, all as shown to best advantage in FIG. 4, thereby enabling the user to effectively "grip" the lower receiver and firearm in a stable and comfortable fire-ready position.

Typically, lower receivers for AR-Type firearms are fabricated of lightweight durable metal such as aluminum and are readily formed using known forming techniques to incorporate the features of my disclosed invention. In this respect, it is preferable to fabricate the receiver so it has slightly increased height. This will lengthen the lower-receiver-end-grip portion 120 to provide increased control and handling of the firearm. As an example, without limitation, I prefer the lower receiver 116 of the invention to be fabricated to have increased height (top to bottom as viewed in FIGS. 4-6) relative to standard on the order of about 0.30 inches to 0.50 inches.

It thus will be appreciated from the foregoing, that by providing the lower-receiver-end-grip portion 120 as an integral permanent portion of the lower receiver and locating through-opening 118 adjacent to trigger opening 23 in accordance with the present invention, the conventional protruding "pistol grip" is obviated, yielding an AR-Type firearm which includes a detachable cartridge magazine, yet can still be used in restricted States.

For more historical background regarding restrictions regarding use of AR-Type firearms by civilians, and for additional details regarding the construction of AR-Type firearms, reference is made to my prior U.S. Pat. Nos. 6,739,082 and 10,330,406, cited above which are hereby incorporated herein by this reference.

The foregoing detailed description is considered as illustrative only of the principles of the invention. Numerous modifications and changes will readily occur to those skilled in the art and therefore, it is not desired to limit the invention to the exact construction and operation shown and described. For example, through-opening 118 also can open into the bottom surface of the bottom receiver via a suitable slot, it being important only that the bottom of the lower-receiver-end-grip portion 120 not extend below or beyond the bottom surface of lower receiver 116. Accordingly, all suitable modifications and equivalents falling within the broad scope of the subject matter described above may be resorted to in carrying out the present invention, being limited only by the spirit and scope of the annexed claims.

What is claimed as being new and desired to be protected by Letters Patent of the United States is as follows:

1. An AR-Type firearm comprising:

a barrel, said barrel being supported on a frame and having a rearwardly extending stock, a lower receiver attached to said frame, said lower receiver having a bottom, said lower receiver having a first portion, said first portion housing a well extending upward through said bottom of said lower receiver for receiving a detachable magazine, said lower receiver having a second portion spaced from said first portion rearwardly toward said stock along said bottom of said lower receiver, a first transverse opening in said lower receiver between said first and second portions thereof for housing a firing mechanism for said firearm, and wherein said second portion defines an end grip engagement terminal surface enabling a user to grip said lower receiver thereby obviating a pistol grip being attached to said lower receiver and extending downwardly beyond the bottom of said lower receiver.

2. The apparatus of claim 1 wherein said end grip engagement terminal surface includes a first portion and a contiguous second portion, wherein said lower receiver includes a stock mounting end face, and wherein said end grip engagement terminal surface first portion extends upward toward the left, and wherein said end grip engagement terminal surface second portion curves to the right to intercept said stock mounting end face.

3. The apparatus of claim 2 wherein both said first portion and said contiguous second portion of said end grip engagement terminal surface are rounded to define a comfortable engagement surface.

4. The apparatus of claim 3 wherein said lower receiver further includes a supplemental second transverse opening between said first transverse opening in said lower receiver and said end grip engagement terminal surface for receiving the middle finger of a user while the user's index finger is placed on the firing mechanism and the user's thenar webspace engages said end grip engagement terminal surface.

5. The apparatus of claim 4 wherein said lower receiver is fabricated of aluminum and said end grip engagement terminal surface is formed therein to be an integral permanent portion of said lower receiver.

6. The apparatus of claim 5 wherein said lower receiver has an enlarged height compared to a standard-sized lower receiver by an amount within the range of about 0.30 inches to about 0.50 inches.

* * * * *